US009943735B2

(12) United States Patent
Rife

(10) Patent No.: US 9,943,735 B2
(45) Date of Patent: Apr. 17, 2018

(54) PUTTER FACE WITH VARIABLE SIZED BALL CONTACT LAND AREAS

(71) Applicant: Guerin D. Rife, Carlsbad, CA (US)

(72) Inventor: Guerin D. Rife, Carlsbad, CA (US)

( * ) Notice: Subject to any disclaimer, the term of this patent is extended or adjusted under 35 U.S.C. 154(b) by 0 days.

(21) Appl. No.: 14/333,497

(22) Filed: Jul. 16, 2014

(65) Prior Publication Data

US 2016/0016050 A1 Jan. 21, 2016

(51) Int. Cl.
*A63B 53/04* (2015.01)

(52) U.S. Cl.
CPC .. *A63B 53/0487* (2013.01); *A63B 2053/0445* (2013.01)

(58) Field of Classification Search
CPC ..... A63B 2053/0445; A63B 53/0487
USPC ..... 473/330, 331, 340, 342
See application file for complete search history.

(56) References Cited

U.S. PATENT DOCUMENTS

| | | | | |
|---|---|---|---|---|
| 1,289,553 | A | 12/1918 | Sanders | |
| 1,337,958 | A | 4/1920 | Reach | |
| 1,536,616 | A | 5/1925 | Manning | |
| 1,965,954 | A | 4/1930 | Davis | |
| 2,005,401 | A | 6/1935 | Storz | |
| D122,795 | S | 10/1947 | Geerlings | |
| D148,193 | S | 12/1947 | Smith | |
| 3,869,126 | A | 3/1975 | Thompson | |
| 4,413,825 | A | 11/1983 | Sasse | |
| 4,468,034 | A | 8/1984 | Duclos | |
| 4,508,349 | A | 4/1985 | Gebauer et al. | |
| 4,690,407 | A | 9/1987 | Reisner | |
| 4,964,641 | A | 10/1990 | Miesch et al. | |
| 5,171,017 | A | 12/1992 | Betancourt | |
| 5,203,453 | A | 4/1993 | Dirito | |
| 5,224,497 | A | 7/1993 | Ehlers | |
| 5,244,409 | A | 9/1993 | Benzel | |
| 5,299,807 | A * | 4/1994 | Hutin | A63B 53/04 473/329 |
| 5,354,059 | A | 10/1994 | Stuff | |
| 5,397,127 | A * | 3/1995 | Kawada | A63B 53/04 473/324 |
| 5,618,239 | A | 4/1997 | Rife | |
| 5,637,044 | A | 6/1997 | Swash | |
| 5,688,186 | A | 11/1997 | Michaels et al. | |
| 5,688,190 | A | 11/1997 | Rowland et al. | |
| 5,709,616 | A | 1/1998 | Rife | |
| 5,779,560 | A * | 7/1998 | Buck | A63B 53/04 473/329 |

(Continued)

OTHER PUBLICATIONS

The Machine M2A Putter, http://forum.mygolfspy.com/topic/4634-machine-m2a-converter-putter-%E2%80%93-part-1-%E2%80%93-the-story-and-the-putter/, Nov. 2011.*

(Continued)

*Primary Examiner* — William Pierce
(74) *Attorney, Agent, or Firm* — Dickinson Wright PLLC

(57) ABSTRACT

A putter type golf club head having a frontal face formed with ball striking, land areas in a repeating patter between the toe and heel and complementary recesses between the land areas. The land areas are smaller than the recesses at the midpoint of the striking face and are progressively larger away from the midpoint on the face providing a progressively larger ball contact area the further the land area is displaced from the midpoint of the striking face.

9 Claims, 3 Drawing Sheets

(56) References Cited

U.S. PATENT DOCUMENTS 5,785,610 A 7/1998 Birmingham
D398,357 S 9/1998 De La Cruz et al.
5,967,903 A * 10/1999 Cheng ..... A63B 53/04 473/342
5,984,801 A 11/1999 Mason
6,110,057 A 8/2000 McKinnon
6,183,379 B1 2/2001 Kim et al.
6,193,614 B1 * 2/2001 Sasamoto ..... A63B 53/04 473/329
6,224,497 B1 5/2001 Antonious
6,257,994 B1 * 7/2001 Antonious ..... A63B 53/0487 473/331
6,368,231 B1 * 4/2002 Chen ..... A63B 53/04 473/329
6,419,593 B1 * 7/2002 Heinrich ..... C23C 4/124 473/324
6,511,386 B1 1/2003 Cacicedo
6,758,759 B2 7/2004 Gobush et al.
6,779,277 B2 8/2004 Sones
6,799,377 B2 10/2004 Sones
68,849,004 2/2005 Lindsay
7,056,226 B2 6/2006 Kennedy
7,621,828 B2 11/2009 Voges
7,635,310 B2 12/2009 Keough
8,066,586 B2 11/2011 Solheim et al.
8,337,324 B2 12/2012 Sander et al.
8,366,566 B1 * 2/2013 Rollinson ..... A63B 53/0475 473/332
8,523,703 B2 9/2013 Rife
8,790,193 B2 7/2014 Serrano et al.
8,986,132 B2 3/2015 Chen
8,986,133 B2 * 3/2015 Bennett ..... A63B 59/0092 473/329
9,149,694 B2 10/2015 Billings
2003/0008731 A1 1/2003 Anderson et al.
2003/0157995 A1 * 8/2003 Mahaffey ..... A63B 53/04 473/342
2004/0030527 A1 2/2004 Rankin
2005/0020376 A1 * 1/2005 Huang ..... A63B 53/047 473/324
2005/0026717 A1 * 2/2005 Jones ..... A63B 53/0487 473/340
2005/0164806 A1 * 7/2005 Solheim ..... A63B 53/0487 473/342
2005/0181888 A1 * 8/2005 Hou ..... A63B 53/047 473/332
2006/0189414 A1 8/2006 Voges et al.
2006/0199661 A1 * 9/2006 Deng ..... A63B 53/047 473/324
2006/0211514 A1 * 9/2006 Deshmukh ..... A63B 53/0466 473/342
2007/0049403 A1 * 3/2007 Chen ..... A63B 53/047 473/342
2007/0072698 A1 * 3/2007 Juang ..... A63B 53/047 473/332
2007/0135229 A1 * 6/2007 Lo ..... A63B 53/0487 473/324
2008/0009363 A1 1/2008 Solodovnick
2008/0076597 A1 * 3/2008 Roach ..... A63B 53/04 473/342
2008/0096687 A1 * 4/2008 Chen ..... A63B 53/047 473/342
2008/0234066 A1 * 9/2008 Jones ..... A63B 53/0487 473/342
2009/0005191 A1 * 1/2009 Lin ..... A63B 53/0466 473/331
2009/0156328 A1 * 6/2009 Reese ..... A63B 53/0487 473/331
2010/0087269 A1 * 4/2010 Snyder ..... A63B 53/0487 473/329
2011/0009211 A1 * 1/2011 Chao ..... A63B 53/0466 473/342
2011/0039636 A1 * 2/2011 Cackett ..... A63B 53/0466 473/342
2012/0196700 A1 * 8/2012 Rollinson ..... A63B 53/007 473/342
2013/0047453 A1 2/2013 Rife
2013/0072321 A1 * 3/2013 Morales ..... A63B 53/04 473/342
2013/0324301 A1 * 12/2013 Boyd ..... A63B 53/04 473/342
2014/0274454 A1 * 9/2014 Snyder ..... A63B 53/047 473/332
2015/0045136 A1 12/2015 Boccieri

OTHER PUBLICATIONS

Truth Digest Mygolfspy, Machine M2A Converter Putter—Part 1—The Story and the Putter, https://forum.mygolfspy.com/topic/4634-machine-m2a-converter-putter-%E2%80%93-part-1-%E2%80%93-the-story-and-the-putter/, Nov. 2011.*
Truth digest Mygolfspy, Machine M2A Converter Putter—Part 1, the Story and the Putter, https://forum.mygolfspy.com/topic/4634-machine-m2a-converter-putter-%E2%80%93-part-1-%E2%80%93-the-story-and-the-putter/, Nov. 2011.

* cited by examiner

PUTTER FACE WITH VARIABLE SIZED BALL CONTACT LAND AREAS

FIELD OF THE INVENTION

The present invention relates to putter type golf club heads and in particular an improved ball striking face configuration for use with putter type golf clubs.

BACKGROUND OF THE INVENTION

Putting surfaces on typical putting greens are not totally smooth and have a variety of imperfections across the surface. Even on finely manicured, more perfect golf greens, when a golf ball comes to rest on the putting surface of a green, just the weight of the ball may cause a slight depression in the green's surface directly under the ball as the golfer walks from the place where the shot to the green was hit to the location on the green where the ball is at rest. Typically most conventional golf putters incorporate a smooth, flat ball-striking face with four to six degrees of loft, it being common wisdom this amount of loft is necessary to cleanly launch a golf ball sitting on the irregular surface. These putters provide a maximum surface area across the face to contact a golf ball. When a golf ball resting on an irregular surface of a green or in a shallow depression caused by the weight of the golf ball is struck with the smooth face type putter described above, the ball travels forward and slightly upward from the surface with a slight backward rotation. As the ball continues on its path to the target it bounces and skids before fully engaging the green's surface. Friction with the putting surface eventually causes the ball to assume a forward roll toward the target.

The undesirable skipping and skidding motion of the ball after the initial strike led to the development of putters with closely spaced grooves on the ball striking face to create lift with only one to two degrees of loft. The gripping effect of the face grooves combined with low loft enables the golf ball to be lifted off the green's surface causing the golf ball to roll almost immediately virtually eliminating the skipping and skidding described above.

Examples of grooved face putters include Applicant's own patents, U.S. Pat. No. 5,618,239, titled Groove Configuration for a Golf Club and U.S. Pat. No. 5,709,616, titled Groove Configuration for a Putter Type Golf Club Head. Both the patents teach the use of closely spaced, straight, horizontal grooves each with a slightly different groove configuration that grips and lifts a golf ball at impact by the putter face. U.S. Pat. No. 5,618,239 teaches the use of asymmetrical saw-toothed shaped grooves. U.S. Pat. No. 5,709,616 teaches the use of symmetrical grooves wherein the land area between the grooves is smaller than the groove spacing. In both of these patents, the reduced land area between the grooves provides a lesser contact surface presented to the golf ball, resulting in a softer hit than a smooth face putter. The groove structure of the grooved putters also allows the striking face to press into or dwell on the surface of the ball fractionally longer. While this increased dwell time produces a more immediate and accurate roll, it also softens the strike thus reducing the distance the ball will travel after impact.

Other attempts at providing a ball striking face configuration for more accurate golf ball roll is shown in U.S. Pat. No. 5,637,044 to Swash that uses a plurality of equally spaced concentric, arcuate grooves surrounding the center of percussion of the ball striking face of the putter. The arcuate configuration promotes the possibility of the ball going further off line when the ball is struck off center on a downward portion of the arcuate groove pattern or when a golfer swings the putter head in a diagonal stroke path creating side spin.

In addition, a wide variety of lines, geometrical designs and decorative patterns on the face of a putter have been used in an attempt to improve the contact between the putter face and the golf ball at impact during the execution of a putting stroke. All of these attempts have a consistent pattern across the putter face. For example, U.S. Pat. No. 6,224,497 to Antonious shows a golf putter with vertical grooves including a disclosed embodiment having grooves of a different vertical width.

U.S. Pat. No. 8,066,586 to Solheim et al teaches the use of grooves having a variable width and corresponding land areas on an iron type golf club, as seen with reference to FIG. 1, to control the way a golf ball reacts when struck with the club. The grooves are wider at the midpoint and are progressively narrower toward the heel and toe of the clubface. There are at least seven different groove configurations with variations of this groove structure. It is seen that the grooves are significantly spaced from each other on the striking face whereby the land areas between the grooves are at least two to three times wider than the width of the adjacent grooves no matter what shape the groove assumes. This spacing is required in order to conform to the requirements of the USGA, the governing body for golf. The spacing between the grooves disclosed in this patent limits or increases the degree of backspin caused by the high speed of an iron type club impacting a golf ball and would have little effect, if any, should the spacing be used with a putter where the impact speed is significantly less.

SUMMARY OF THE INVENTION

For any given putter shape, weight or face configuration, the maximum roll that a ball will travel for a given force applied to the golf ball by the putter face is achieved when the ball is struck precisely on the center of percussion. Conversely, a golf ball travels a progressively lesser distance the further it is hit away from the center of percussion. This effect occurs with both conventional smooth face putters and grooved face putters.

For the purpose of understanding the present invention it is important to note that when comparing an identical hit with both a conventional, smooth faced putter and a grooved putter, the ball hit with the conventional putter will travel further. This is because there is greater contact surface on the smooth face of the conventional putter that engages the ball whereas the contact surface or land area between the grooves on a grooved putter that actually strikes a golf ball is reduced by up to 70% by the grooves.

The present invention is directed to a putter type golf club formed with a frontal ball striking face having land areas and complementary recesses whereby only the land areas strike against the golf ball during the putting stroke. Specifically the frontal face of the putter is provided with a unique ball striking, land configuration that enables a player to provide a consistent roll to a golf ball struck on the club face for a given impact force applied by the golfer, particularly when the ball is struck off of the precise center of percussion.

This is accomplished by the size of the land areas on the face being progressively larger the further they are away from the midpoint/center of the face such that the land area is smaller at the center midpoint of the face and progressively becomes larger outwardly from the center midpoint toward the heel and toe portions of the putter face. The progressively larger land areas provide a greater impact against the golf ball where typically miss-hits occur, and conversely a lesser dwell time with the golf ball, resulting in a greater rebound effect such that a golf ball will travel further when struck with essentially the same amount of impact force against the golf ball. This increased impact force compensates for an off-center strike against the ball so the ball will roll essentially the same distance no matter where on the face the ball is struck. Stated in other words, the loss in distance resulting from an off-center strike on the putter face is compensated for by the greater rebound effect of the larger land area at the point of impact on the club face and the ball rolls essentially the same distance even when the ball is struck off the midpoint of the putter face.

In accordance with the principles of the present invention, the size of the land area or contact surface of the putter face is less in the center than the complementary recess areas between the land areas and becomes progressively greater toward the heel and toe portions of the club face. With this club face structure, the lesser travel distance of the golf ball that would normally occur as a result of an off-center hit is compensated for by a greater rebound effect of the progressively greater land area further from the center of the striking face. The end result is that the golf ball travels similar distances on both center and off-center hits.

In a number of preferred embodiments, the variation in land area is accomplished in a variety of ways using the placement of recessed, non-contact areas on the putter face such that the contact surfaces are less at the center of percussion and progressively greater toward the heel and toe of the striking face of the putter. In these preferred embodiments, the land area at the center of percussion, or midpoint on the face of the putter, is smaller than the adjoining recessed area that is milled or otherwise formed in the face. Similarly the size of the land areas progressively increases, becoming larger than the adjoining recessed areas, away from the midpoint of the face toward the heel and toe portions of the face.

The land and recessed areas may be different sizes and different shapes such as, but not limited to, grooves, ovals, milling, circles, rectangles, triangles, irregular shapes, or a combination of shapes configured in such a way that the contact surface is progressively greater away from the center of percussion on a putter face.

Other preferred embodiments of the putter face in accordance with the present invention provide land areas that strike the golf ball that are raised above the putter face. In these embodiments the raised areas are smaller at the midpoint of the face and become progressively larger toward the heel and toe of the putter.

Among the objects of the present invention is the provision of a putter type golf club head with a progressively variable land area configuration between recessed areas on the putter face.

Another object is the provision of a putter face configuration that creates different roll characteristics in accordance where the ball is struck on the face.

Still another object is the provision of a putter face configuration that provides a softer impact with the ball, the closer to the center of the face that the ball is struck.

Still another object is the provision of a putter face configuration that provides a greater impact with the ball, the further away from the center of the face that the ball is struck.

These and other objects will become apparent with reference to the following specification and accompanying claims.

DESCRIPTION OF PREFERRED EMBODIMENTS

Figure 1:
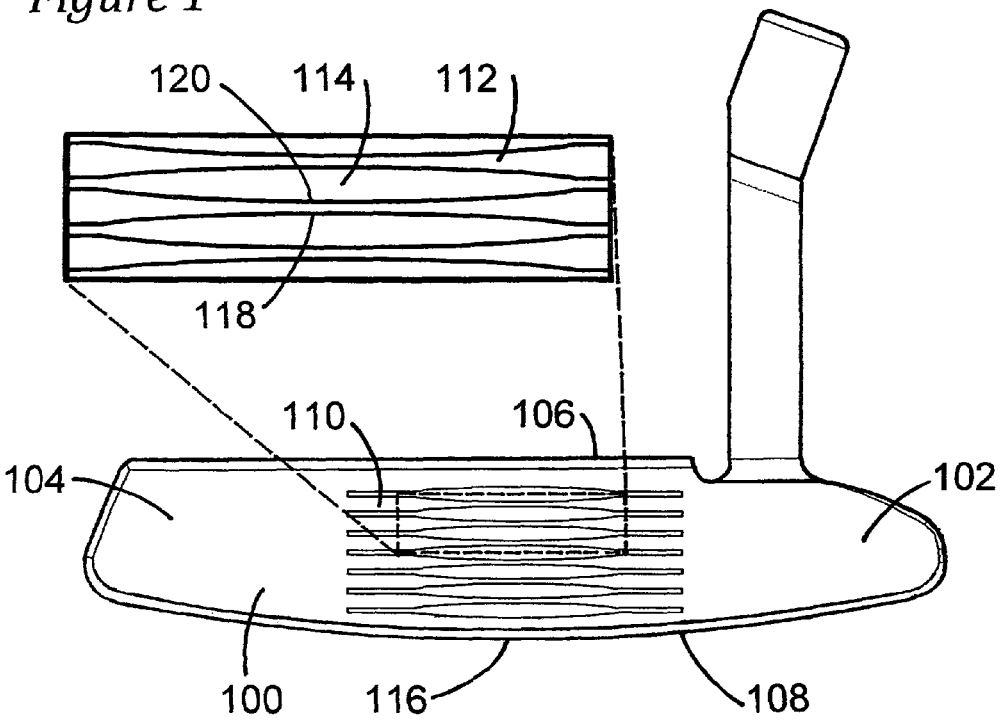
FIG. 1 is a front elevational view of a putter type golf club in accordance with the present invention including an exploded section of the land area adjacent the midpoint of the putter face.

Referring to the drawings, FIG. 1 illustrates a putter type golf club head 100 including a heel 102, toe 104, top surface 106 and bottom 108. The club head 100 is provided with a ball striking face 110 that is generally smooth and flat extending between the heel 102 and toe 104. In keeping within the scope of the invention, it will be appreciated that the club head 100 may be of any size and shape, such as a blade shape, mallet shape, and/or a heel/toe weighting configuration, or combinations thereof.

In the present embodiment, as seen in the exploded portion of FIG. 1, the striking face 110 includes a series of land areas 112 that contact the golf ball during the execution of a putting stroke that are located between elongated and tapered, oval shaped recesses 114. The land areas 112 and recesses 114 extend in a heel 102 to toe 104 direction on the striking face 110 and are formed in a non-linear configuration such that the land areas 112 are smaller and the complementary recesses 114 are larger at the center 116 of the striking face 110. In addition, the width of the land area 112 at the midpoint 116 is less than the adjacent recess 114 and becomes progressively larger and wider toward the heel 102 and toe 104 of the face 110. This structure results in less of the striking face 110 contacting a golf ball when struck at the midpoint/center 116, since the land areas 112 that actually contact the ball are narrower at that location.

In like manner, the recesses 114 become progressively narrower as they extend outwardly toward the heel 102 and toe 104 away from the midpoint/center 116 of the striking face 110. As the recesses 114 become narrower, the complementary land areas 112 between the recesses 112 become wider. This progressive widening of the land areas 112 creates more contact area that is presented to the golf ball. This, in turn, produces a more solid strike of the golf ball during the execution of a putting stroke since more of the land area 112 of the striking face 110 actually contacts the golf ball.

By carefully measuring the rebound effect of a golf ball with off center hits and adjusting the width of the land area at that location, the deadening effect of the off-center strike against the golf ball can be precisely compensated for to control the distance the ball rolls to be essentially the same across the face where golf balls are generally struck. Referring to FIG. 1, the recesses 114 are the widest at the midpoint 116 of the club face 110 and are formed with an arcuate upper edge 118 and an arcuate lower edge 120. As the recesses 114 extend toward the heel 102 and toe 104. The arcuate upper edge 118 and arcuate lower edge 120 are located closer to each other and terminate at a point where typically miss-hits do not occur and continue with a parallel upper and lower edge configuration toward the heel 102 and toe 104.

FIGS. 2 to 6 illustrate exploded and enlarged, partial views of alternate embodiments of ball striking faces of the present invention having land area configurations that are applicable to putters of the type disclosed in FIG. 1.

Figure 2:
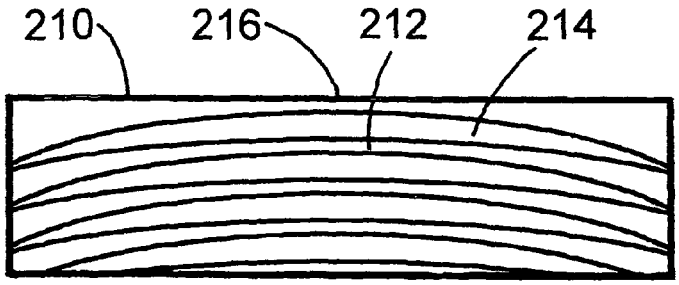
FIG. 2 illustrates a second embodiment of another enlarged area of a putter striking face in accordance with the present invention.

FIG. 2 illustrates an enlarged section of a club face 210 having a land area configuration 212 formed between downwardly configured arcuate recesses 214. As with the first embodiment illustrated in FIG. 1, the land areas 212 are narrower than the recesses 214 at the midpoint 216 of the club face 210 and become progressively wider away from the midpoint 216.

Figure 3:
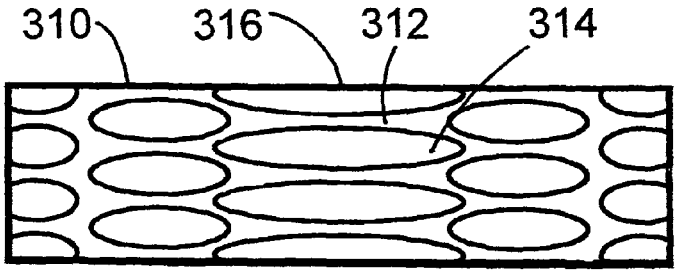
FIG. 3 illustrates a third embodiment of an enlarged area of a putter striking face in accordance with the present invention.

FIG. 3 illustrates an enlarged section of a club face 310 having a land area configuration 312 defined by the area between a series of elongated, tapered oval shaped recesses 314. As can be seen in the drawing, the land areas 312 are smaller than the oval recesses 314 at the midpoint 316 of the club face 310 creating less land area 312 at that point. As the oval recesses 314 are located away from the midpoint 316 they are progressively smaller thereby creating a progressively larger land area 312 away from the midpoint 316.

Figure 4:
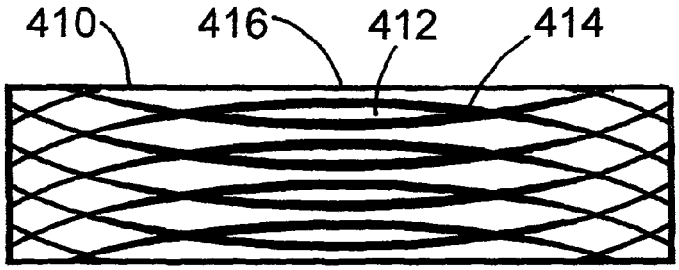
FIG. 4 illustrates a fourth embodiment of an enlarged area of a putter striking face in accordance with the present invention.

FIG. 4 illustrates an enlarged section of a putter type club face 410 having a milling pattern with raised land areas 412 and milled recesses 414. The milling pattern is more closely spaced at the midpoint 416 of the club face 410 and separates away from the midpoint 416 to provide greater land areas 412 away from the midpoint 416.

Figure 5:
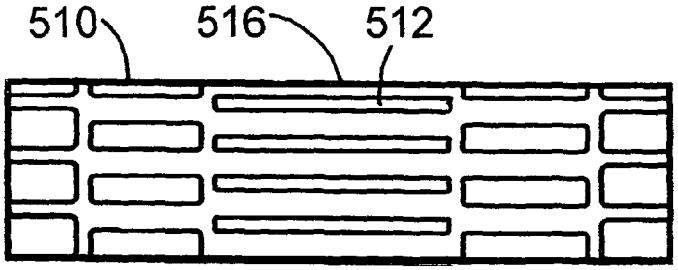
FIG. 5 illustrates a fifth embodiment of an enlarged area of a putter striking face in accordance with the present invention.

FIG. 5 illustrates another enlarged section of a putter type club frontal face 510 having raised land areas 512 formed as rectangular geometrical shapes. The frontal face 510 is recessed 514 relative to the raised land areas 512 whereby only the land areas 512 engage the golf ball during the execution of a putting stroke. Preferably the upper surfaces of the land areas 512 are flat in order to present a smooth area to engage the golf ball. The land areas 512 are progressively wider or larger as they are located further from the midpoint 516 of the frontal face 510 thereby providing increased contact area for engaging a golf ball the further the ball is struck away from the center of the putter during the execution of a putting stroke.

Figure 6:
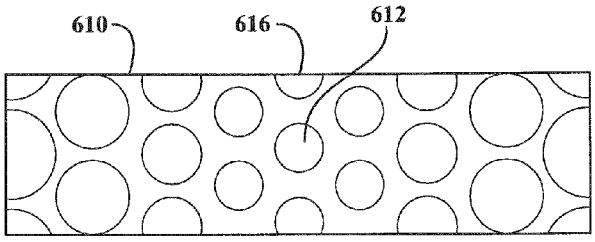
FIG. 6 illustrates a sixth embodiment of an enlarged area of a putter striking face in accordance with the present invention.

FIG. 6 illustrates another enlarged section of a putter type club frontal face 610 having raised land areas 612 formed in a circular shape. The frontal face 610 is recessed 614 relative to the raised circular land areas 612 whereby only the land areas 612 engage the golf ball during the execution of a putting stroke. As with the previous embodiment, preferably the upper surfaces of the circular land areas 612 are flat in order to present a smooth surface area to engage a golf ball.

Figure 8:
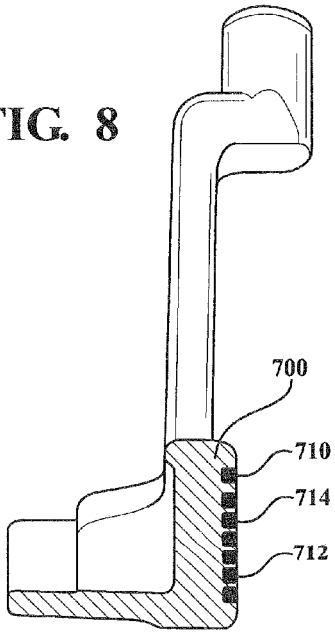
FIG. 8 is a cross-sectional view taken along the midline c/l shown in FIG. 7.
Figure 7:
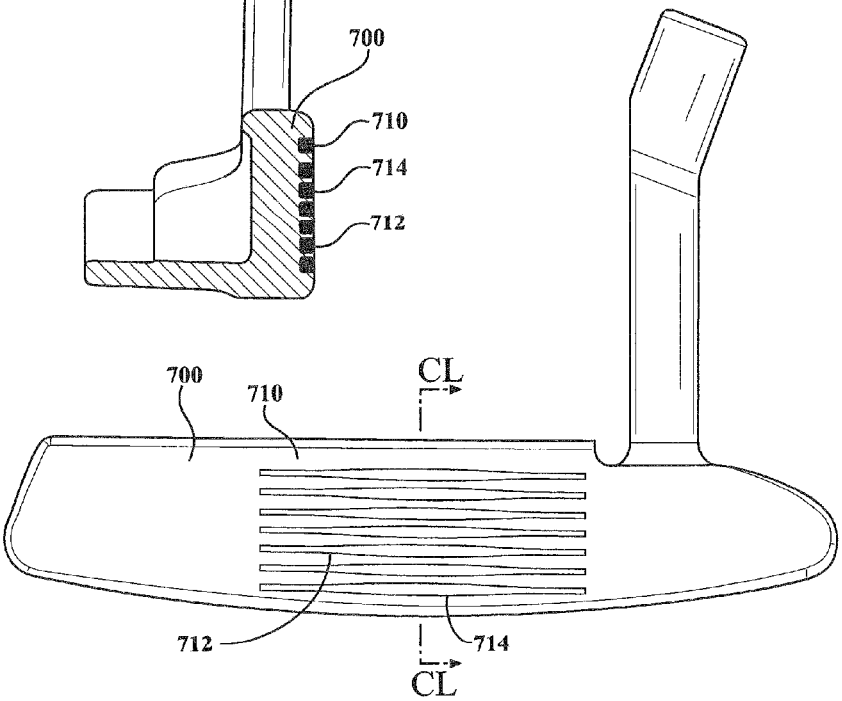
FIG. 7 illustrates another embodiment of a golf putter striking face in accordance with the present invention.

FIGS. 7 and 8 illustrate still another embodiment of a putter type golf club 700 having a club face 710 with rigid land areas 712 and complementary recesses 714 filled with a softer, non-metallic material, such as polymer, that deadens or softens the strike of the face 710 against a golf ball. As with the previous embodiments, the rigid land areas 712 increase as they are located away from the midpoint of the face 710.

All of the above embodiments are defined by progressively increased land areas the further they are away from the midpoint of the striking face toward the heel and toe thus providing increased contact against the ball to compensate for off-center hits of the golf ball. It will be appreciated that any geometrical configuration may be used and that the invention is not limited by the descriptions in this specification.

In addition to the examples shown above, the recesses may be any geometrical shape such as square, triangular or may even be an amorphous shape as long as there is a greater concentration of recesses at the midpoint of the face and a lesser concentration away from the midpoint. Likewise the configuration of the raised land areas may take various shapes as long as the raised members become progressively larger as they are located further from the midpoint.

The invention claimed is:

1. A golf club header having a plurality of land areas defining ball-contact areas for contacting a ball and a plurality of recesses defining non-ball-contact areas between and among the ball-contact areas, said club head comprising;

a frontal face extending between a heel and a toe at opposite ends of said of said frontal face of said golf club head respectively, said frontal face having a midline located midway between said heel and said toe respectively, said frontal face including a plurality of the recesses disposed into and below said said frontal face to establish the non-ball-contact areas said plurality of land areas among said recesses and being on said frontal face to establish the ball-contact areas for contacting a golf ball, said recesses and said land areas extending from said midline toward said heel and toward said toe respectively, said land areas being spaced from one another along said midline by said recesses and each of said land areas having a size establishing a ball-contact area smaller along said midline than said non-ball-contact area of said recesses along said midline, each of said recesses being progressively smaller on said frontal face in proportion to each of said land areas being progressively larger on said frontal face outwardly away from said midline toward said heel and toward said toe respectively, and each of said land areas having a ball contact area greater than each of said non-ball-contact areas at said outward positions.

2. The golf club head of claim 1 wherein said land areas are connected as one integrated surface from said midline toward said heel and to said toe respectively.

3. The golf club head of claim 1 wherein said land areas presents a plurality of discontinuous surfaces from said midline to said heel and said toe.

4. The golf club head of claim 1 wherein said recesses are a geometrical shape.

5. The golf club head of claim 4 wherein said geometrical shape of each of said recesses is an elongated and tapered oval.

6. The golf club head of claim 1 wherein said shape of each said recesses is arcuate.

7. The golf club head of claim 1 wherein each of said recesses is filled with a non-metallic material.

8. A golf club head as set forth in claim 1 including;

said frontal face having a top edge, said recesses including a plurality of first recesses being convex relative to said top edge, said recesses including a plurality of second recesses being concave relative to said top edge, said first recesses and said second recesses intersecting one another to define a plurality of said land ball-contact areas on said plane of said frontal face for contacting the golf ball with said land ball-contact areas disposed between said first recesses and second recesses.

9. A golf club head comprising;

a frontal face having land areas defining ball contact areas for contacting a golf ball and recesses defining non-ball-contact areas, said frontal face further defining a plane extending between a heel and a toe on opposite ends of said frontal face respectively, said frontal face having a midline oriented vertically and located between said heel and said toe respectively when oriented horizontally, said recesses further defined as disposed into and below said plane of said frontal face to establish said non-ball-contact areas, said ball contact land areas defined as being on said plane of said frontal face and separated by said recesses, said land areas and said recesses alternating vertically along said midline and extending from said midline across said frontal face toward said heel and said toe respectively, said land areas having a ball contact area smaller at said midline than the area of said non-ball-contact areas at said midline, and said land areas being progressively larger on said plane of said frontal face in proportion to said recesses being smaller on said plane of said frontal face away from said midline toward said heel and toward said toe respectfully to outward positions with said land areas having a ball contact area larger than said non-ball-contact areas at said outward positions.

* * * * *